US008006780B2

(12) United States Patent
Fabris

(10) Patent No.: US 8,006,780 B2
(45) Date of Patent: Aug. 30, 2011

(54) METHOD OF ATTACHMENT OF A TOWING ANCHOR TO AN ICEBERG

(76) Inventor: Mario Fabris, Grimsby (CA)

( * ) Notice: Subject to any disclaimer, the term of this patent is extended or adjusted under 35 U.S.C. 154(b) by 422 days.

(21) Appl. No.: 12/288,761

(22) Filed: Oct. 24, 2008

(65) Prior Publication Data

US 2009/0120688 A1 May 14, 2009

(51) Int. Cl.
*E21B 7/00* (2006.01)
*E21B 7/14* (2006.01)

(52) U.S. Cl. ..... 175/17; 175/18

(58) Field of Classification Search ..... 175/18, 175/17, 213, 393; 405/217
See application file for complete search history.

(56) References Cited

U.S. PATENT DOCUMENTS

| | | | | |
|---|---|---|---|---|
| 629,539 | A * | 7/1899 | Bertram | 175/18 |
| 2,786,652 | A * | 3/1957 | Wells | 175/25 |
| 3,680,645 | A * | 8/1972 | Horbach et al. | 175/16 |
| 3,951,220 | A * | 4/1976 | Phillips et al. | 175/393 |
| 4,100,981 | A * | 7/1978 | Chaffin | 175/60 |
| 4,178,872 | A | 12/1979 | Mougin et al. | 115/72 |
| 4,223,627 | A | 9/1980 | Mougin | 114/242 |
| 4,640,552 | A * | 2/1987 | Page | 299/24 |
| 6,688,105 | B1 | 2/2004 | Shick | 60/641.1 |

* cited by examiner

*Primary Examiner* — Hoang Dang
(74) *Attorney, Agent, or Firm* — Edward H. Oldham

(57) ABSTRACT

A drilling bit for penetrating an iceberg a predetermined distance to establish an anchor point for towing the iceberg to a predetermined location. The drilling bit has three sections for achieving its goal. It has a cutting head, a torque transmission body and a driving end for coupling to a power-twisting device which energizes the bit. The bit has separate passageways therein to permit the bit to remove water and ice produced by the cutting head during a drilling operation. The drill has a passageway for circulating liquid nitrogen therein to cause the water remaining in the hole to freeze to the drill bit solidly into the iceberg. The drill bit is also provided with a heating coil resistor to melt the area where the bit is held captive by the frozen ice.

6 Claims, 1 Drawing Sheet

METHOD OF ATTACHMENT OF A TOWING ANCHOR TO AN ICEBERG

FIELD OF INVENTION

This invention relates to the establishment of an anchor somewhere in the surface of an iceberg which allows the iceberg to be towed to a predetermined designated destination. The anchor is embedded in the iceberg by drilling and the anchor bit may be in the order of 100 feet long and it will be expected that about 15-20 feet of the drill will be permanently anchored in the iceberg. The diameter of the anchor drill bit will be about 12-18 inches in order to provide the necessary robustness to tow the iceberg and yet provide the necessary passages inside the bit for the water and ice chips which are allowed to flow inside the anchor bit during a drilling operation. Passages are also provided for the flow of liquid nitrogen etc. which are necessary to cool the exterior surface of the anchor so as to freeze the anchor in place in the selected iceberg.

BACKGROUND OF THE INVENTION

Icebergs are a peculiar phenomenon. The process by which they are formed varies as to whether the icebergs themselves originate in the Arctic or Antarctic Oceans. The icebergs produced in the Antarctic tend to be of a flatter nature than those produced in the north and the Antarctic icebergs have become know as "tabular" or flattened icebergs. The northern variety of icebergs are formed in a completely different manner such as those formed off the coast of Greenland and these icebergs may be found in a variety of shapes, having no particular dominant shape.

The icebergs which are formed in the Antarctic are generally flat elongated bergs having a flat appearance. Both types of icebergs can be very large, weighing in the order of several billion tons and the water which composes the iceberg is essentially "fresh".

So there are basically two entirely different forms of iceberg to deal with, tabular and non-tabular. Both are produced by a process known as calving, that is breaking off the large ice formation which has been formed over the years at either pole. The breaking up of an iceberg whilst it is floating in the ocean current is also known as calving.

There are generally only two reasons why one would seek to alter the path of an iceberg; first to prevent or limit damage to a structure which stands in the path way of the drifting iceberg, usually a drilling rig or platform, and the second reason is to attempt to deliver the iceberg to a country where fresh water is in demand. It must be remembered that all icebergs are composed of water which is low in salinity.

SUMMARY OF THE INVENTION

This invention seeks to provide an anchor in an iceberg of either the tabular or the non-tabular type, and then tow the iceberg to its final destination using tugs or ocean going ships. The power requirements are high; in the order of hundreds of tons to pull a drifting iceberg to a predetermined destination.

The anchor must fulfill several conditions.

It must be rigidly attached to the iceberg to permit a towing force (of several hundred tons) to be transferred to the iceberg during the transit of the iceberg; the voyage from the mid Atlantic Ocean to a final destination in an equatorial country which may take several months to complete, and during this time the non-tabular icebergs from the Arctic Ocean may roll over several times due to a shift in the center of gravity.

During this time, regardless of the constant erosion of the iceberg caused by melting, the anchor must remain securely fastened to the iceberg.

The anchor used in this application takes the general shape of a giant drill, one end having a cutting head mounted thereon, for piercing its way into the body of the iceberg.

Next there must be a passageway provided in the drill for the removal of ice and water produced during a drilling operation. This same passageway may be used during the transfer of the iceberg to carry liquid nitrogen into the anchor which is buried in the iceberg so as to cause any water contained in the pierced cavity to freeze solidly around the anchor and thus enable the iceberg to be "towed".

Lastly, the drilling device must contain a heating element so that the device may be removed when it is necessary to remove the anchor from the iceberg. With the non-tabular icebergs it may be advantageous to completely relocate the anchor once a new center of gravity for the iceberg is established.

The drill may be provided with a series of circumferential grooves in the outer surface of the stepped cylindrical shaft of the drill to increase the interference fit of the drill in the iceberg to thus increase the force which may be transferred to the iceberg.

The water passage previously used to collect water and ice particles during a drilling operation may be used upon some slight modification to provide a conduit in the drill through which liquid nitrogen may be circulated to assure that the drill is rigidly fixed in the drilled hole by freezing the ice surrounding the anchor during the entire towing operation.

DESCRIPTION OF THE PREFERRED EMBODIMENT

Figure 1:
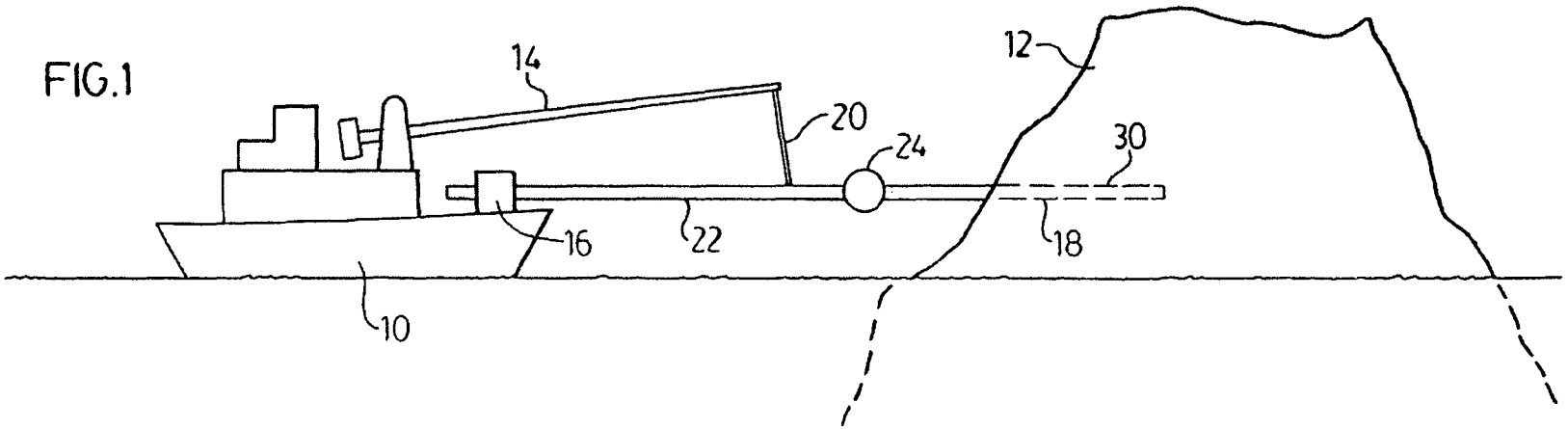
FIG. 1 shows an illustration of a tug and an iceberg having an anchor attached.

Referring now to FIG. 1 where a tug 10 is being used to bore a passage in an iceberg 12 in order to provide a towing anchor for the iceberg 12. The tug 10 is provided a jib crane 14 and a turret type device 16 for driving a drill 18 into iceberg 12. The jib crane serves to provide a cable lift 20 to lift the drill string 22 a predetermined distance above the water. A swivel joint 24 is shown in the drilling string 22 to permit the iceberg some freedom of movement while transmitting rotational torque to drill 18.

Before proceeding further with the boring and mounting of the drill bit in the iceberg a word or two about the operation should be given here. First, a suitable iceberg must be chosen for haulage. If the tug 10 is operating the north Atlantic, then the icebergs will be from the ice shelf at the Arctic Ocean and the iceberg will have any irregular shape, being of the non-tabular type. The iceberg will be chosen for its size and shape, both attributes are important because it may be almost impossible to influence the drift course of a really large ice berg (3,000,000,000 tons) and if possible it would be expedient to find an iceberg that was amenable to drilling a hole in a surface thereof for setting the anchor in the iceberg.

The apparatus of this invention must be capable of operation in rough waters thus the jib crane and the drill rig must be operable in all sorts of weather.

Figure 2:
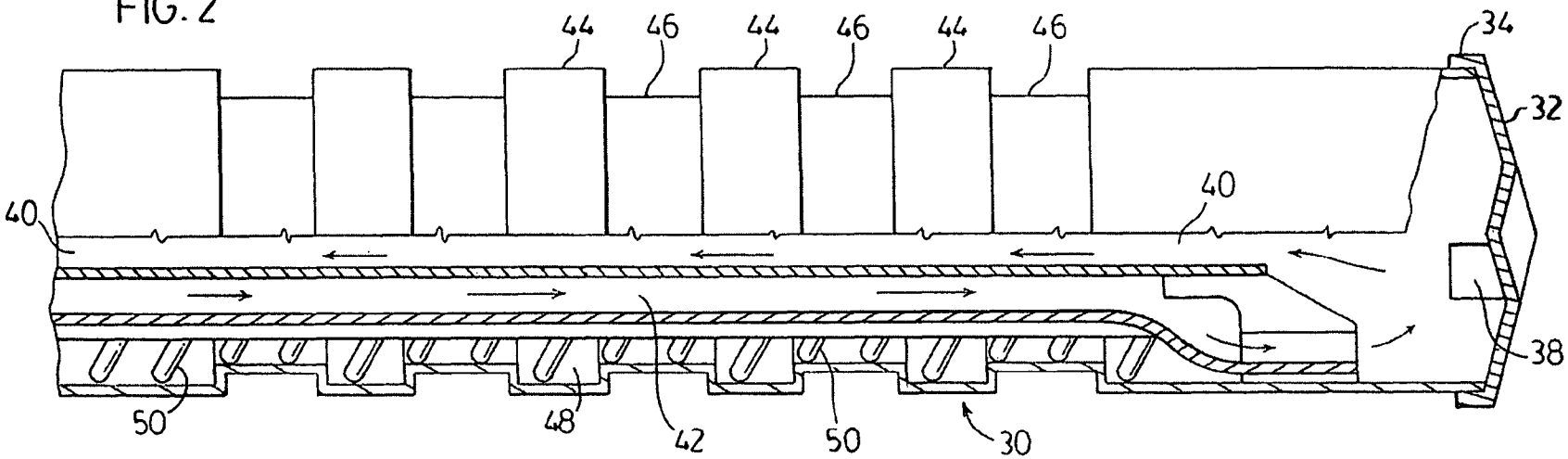
FIG. 2 is an elevational view partially in section of an anchor bit of this invention.

When a suitable iceberg has been selected for the towing operation, the drill rig and jib crane are activated and the drilling operation at the surface selected of iceberg 12 begins. The drilling begins and the drill bit 30 as shown in FIG. 2 is sunk into the iceberg 12. The depth of penetration of the drill bit 30 will be from about 15-20 feet into the iceberg and it will be noted that the drilling end 32 of the bit 30 will resemble the sharpened end of a typical fluted drill. Note that drill 30 is provided with a cut or head extensions 34 which will provide a clearance hole for the main body of drill 30 in the hole being drilled.

While the drilling operation progresses, the drill is provided with a water flush to capture and carry any chips and crushed bits of ice which are collected at end 32 of drill 30 and are delivered via port 38. There the water mixes and carries the crushed ice back to the end 40 of drilling bit 30 via conduit 40 in drill 30. Water is delivered to the head end 32 of drill 30 via conduit 42.

The exterior surface of drill 30 is interrupted by a series of stepped grooves 44, 46 shown in FIG. 2 which increase the surface contact of the drill 30 and iceberg 12. This makes it all but impossible to remove the drill anchor from the iceberg 12 once it has been set in iceberg 12 by freezing.

Separate water conduits 40 and 42 are used to circulate the water in the drill 30.

Next liquid nitrogen is circulated through the drill once the desired penetration of the drill 30 has been achieved in the iceberg 12. The temperature of the liquid nitrogen is about −196° C. By keeping the temperature of the anchor drill at this low value, the possibility of the iceberg calving during the transit operation at the point of anchor is greatly reduced. The liquid nitrogen is circulated in this instance in chamber 48 of drill 30. It will be seen that once the outside water has been frozen by the circulating liquid nitrogen that ridges 44-46 hold the drill bit in the iceberg.

Lastly, the contacting surface of the anchor drill and the iceberg may be heated using coil 50 as shown in FIG. 2. In this instance, when the iceberg has reached its final destination and it is desired to remove the anchor drill from its anchor position heating coil 50 is energized to bring the temperature of the embedded drill to a point well above the melting point of the ice and the drilling anchor may be swiftly removed from its location in iceberg 12.

The liquid nitrogen may be circulated in the same channels 40 and 42 in which the drilling water has previously circulated or it may be circulated in a separate channel designed for that purpose such as shown here.

The swivel device 24 allows the iceberg 12 freedom to move around during a towing operation. Swivel 24 can be constructed in accordance with universal joint knowledge.

It is believed that many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that the modifications and embodiments are intended to be included within the scope of the dependent claims.

What is claimed:

1. A drilling device for drilling a passageway in an iceberg comprising:

said device having the general shape of a drill for drilling a hole in said iceberg;

said device having a plurality of internal fluid passageways formed therein for circulating fluid therein;

said device having ports connected to a selected number of said passageways to permit the passage of drilling fluids and ice into and out of selected passageways of said drilling device during a drilling operation;

wherein certain internal passageways are formed in said device which may be used to circulate coolant fluids therein which may beof a lower temperature than that of said iceberg to lower the surface temperature of said device in said iceberg;

and wherein said drilling device is connected to a torque producing device by a swivel joint.

2. An elongated drill bit for drilling a hole in an iceberg comprising a drill bit having first and second ends;

said first end of said drill bit having means for suitable attachment to a rotating drill string to cause said drill bit to rotate;

a second end of said bit being of the shape of a pointed drill so as to form a cutting head for said drill bit, said elongated body being of tubular shape and having passageways formed therein for carrying fluids to and from said first and second ends of said drill bit, where at least one of the passageways formed in said body is in communication with a port in said cutting head, said port serving to permit the entry of water and ice particles from said iceberg to said passageway during a drilling operation, and wherein said cutting head has a cutting diameter slightly larger than the diameter of said body, and wherein said body has an external body shape having stepped diameter changes of increasing and decreasing diameter adjacent one another, wherein said bit has an internal cavity which contains a coiled resistor apparatus which extends the length of the body which is capable of heating the bit in areas in contact with said iceberg.

3. An anchor for attachment to an iceberg comprising:

an elongated drilling device having an ice drilling head formed at one end thereof, said drilling device having at least one internal passageway formed therein for circulating water and ice chips therethrough, said head having at least one port formed therein for allowing the passage of ice particles into said passageway during a drilling operation, said device also having heating means mounted in another passageway to cause said anchor to be heated to facilitate removal from said iceberg.

4. An anchor as claimed in claim 3 wherein said heating means is an electric resistor coil.

5. An anchor as claimed in claim 3 wherein said heating means is a hot fluid circulated in said anchor.

6. A method of attaching an anchor to an iceberg comprising:

selecting a suitable iceberg for the attachment of said anchor, and supplying a rotatable drill string having a suitable torque producing means attached to a first end of said drill string, and attaching a suitable drill bit to the other end of said drill string; and providing a suitable swivel joint in said drill string at a location between said first and said other end of said drill string, and drilling into said iceberg at a predetermined location with said drill bit, cooling said drill bit in said iceberg when a predetermined penetration of said iceberg is reached.

* * * * *